United States Patent [19]

Hayakawa et al.

[11] Patent Number: 4,904,006

[45] Date of Patent: Feb. 27, 1990

[54] DOOR LOCK ASSEMBLY FOR AUTOMOTIVE VEHICLES

[75] Inventors: Shigeru Hayakawa, Chiryu; Ryoichi Fukumoto, Nagoya; Nozomu Torii, Hekinan, all of Japan

[73] Assignee: Aisin Seiki Kabushiki Kaisha, Kariya, Japan

[21] Appl. No.: 103,458

[22] Filed: Oct. 1, 1987

[30] Foreign Application Priority Data

| | | | |
|---|---|---|---|
| Oct. 6, 1986 | [JP] | Japan | 61-237690 |
| Oct. 6, 1986 | [JP] | Japan | 61-237691 |
| Apr. 30, 1987 | [JP] | Japan | 62-107542 |

[51] Int. Cl.[4] ..... E05C 3/26

[52] U.S. Cl. ..... 292/336.3; 292/216; 292/DIG. 38; 292/DIG. 27; 292/201

[58] Field of Search ..... 292/201, 216, 336.3, 292/280, DIG. 27, DIG. 38; 74/625, 411

[56] References Cited

U.S. PATENT DOCUMENTS

| | | | |
|---|---|---|---|
| 3,190,682 | 6/1965 | Fox et la. | 292/216 |
| 4,093,289 | 6/1978 | Inabayashi et al. | 292/DIG. 62 X |
| 4,252,351 | 1/1981 | Yoshino et al. | 292/201 |
| 4,290,634 | 9/1981 | Gelhard | 292/201 |
| 4,588,217 | 5/1986 | Escaravage | 292/201 |
| 4,616,527 | 10/1986 | Frey et al. | 74/625 |

FOREIGN PATENT DOCUMENTS

| | | |
|---|---|---|
| 3120000 | 12/1982 | Denmark . |
| 3433893 | 3/1985 | Denmark . |
| 0095988 | 12/1983 | European Pat. Off. . |
| 0153231 | 8/1985 | European Pat. Off. . |
| 0188106 | 7/1986 | European Pat. Off. . |
| 2390568 | 12/1978 | France . |
| 54-30317 | 10/1977 | Japan . |
| 57-68480 | 10/1980 | Japan . |
| 59-109678 | 12/1982 | Japan . |
| 62-6077 | 6/1985 | Japan . |
| 62-6078 | 6/1985 | Japan . |

*Primary Examiner*—Richard E. Moore

*Attorney, Agent, or Firm*—Finnegan, Henderson, Farabow, Garrett and Dunner

[57] ABSTRACT

A door lock assembly includes a door lock operating unit having a locking arm, and an actuator for driving the locking arm to a locked position and unlocked position. The actuator has an operating lever which rocks together with the locking arm, a neutral position restoration level which, when in a neutral position, is in a state non-engagable with the operating lever and, when displaced from the neutral position, drives the operating lever to the locked position and unlocked position, an output member which makes contact with and separates form the neutral position restoration lever for driving the neutral position restoration lever to the locked position and unlocked position, and a motor for driving the output member.

14 Claims, 9 Drawing Sheets

DOOR LOCK ASSEMBLY FOR AUTOMOTIVE VEHICLES

BACKGROUND OF THE INVENTION

This invention relates to an automotive vehicle door lock assembly for automatically locking and unlocking a door manually as well as electrically using a miniature motor.

A door lock assembly of this type is disclosed in e.g. the specification of Japanese Utility Model Publication (KOKOKU) No. 54-30317 (hereinafter referred to as "the former") and the specification of Japanese Patent Application Laid-Open (KOKAI) No. 57-68480 (hereinafter referred to as the "latter").

As shown in FIG. 14, the former discloses an arrangement in which a reduction gear unit 30 has a stroke larger than a stroke distance L of an operated lever 31 on both sides of a neutral position. The gear reduction unit 30 and the operated lever 31 are connected via connecting means 32 having play 32*a* equivalent to the stroke distance L of the operated lever 31. Also provided is a spring 33 biasing the gear reduction unit 30 in the neutral position.

As shown in FIGS. 15 and 16, the latter discloses an arrangement including an intermediate reduction gear 43 meshing with a pinion 42 of a motor rotary shaft 41, and an intermediate pinion 46 meshing with a rocking gear 45 connected to an output shaft 44 for operating an operated lever 50 of the door lock proper. The intermediate reduction gear 43 and intermediate pinion 46 are supported on the same shaft and are provided so as to be freely engagable via a resilient body 47 through rotational play and an angle which correspond to the stroke of the operated lever 50. After the assembly is locked and unlocked by a motor 40, the intermediate reduction gear 43 is reversed by the resilient body 47.

The former door lock assembly has a structure in which lost motion is allowed to occur at an oblong hole 32*a* provided at the portion where the connecting means 32 and lever 31 are connected. Consequently, it is required that the gear reduction unit 30 have a stroke which is about twice the stroke length L of the operated lever 31. As a result, the door lock assembly is large in size. Furthermore, since the spring 33 constantly subjects the motor to a rotational load, motor loss is great and a high-output motor is required.

The latter door lock assembly has a structure in which the intermediate speed reduction gear 43 inclusive of the motor rotary shaft 41 is restored to the neutral position by the restoration force of the resilient body 47. Consequently, if there is a drop in the operating voltage or an increase in the turning resistance of the shaft portions due to the passage of time or the like, the intermediate reduction gear 43 will not readily return to the neutral position and it will be required that the user apply a greater operating force when the door lock is operated manually.

The aforementioned drawbacks of the prior art constitute a first problem to be solved by the present invention.

Accordingly, a first object of the present invention is to provide a door lock assembly which solves the aforementioned problem encountered in the prior art, specifically a structurally simple and compact door lock assembly capable of performing a locking and unlocking operation with application of a small operating force when the door lock is operated manually as by a locking button or key.

A further description of the door lock assembly disclosed in the abovementioned Japanese Patent Application Laid-Open (KOKAI) No. 57-68480 will be given with reference to FIG. 17. Here the door lock assembly is shown to comprise a locking arm 231 freely rockably connected to a door lock operating unit 230, an actuator 232, and a combination of a rocker arm 233 and connecting rod 234 for transmitting the output of the actuator 232 to the locking arm 231.

Owing to vehicle design and space limitations, the actuator 232 for performing an electrical locking and unlocking operation in this conventional door lock assembly is provided at a position comparatively far from the door lock operating unit 230. Accordingly, the arrangement is such that the output of the actuator 232 is transmitted to the locking arm 231 via such elements as the rocker arm 233 and connecting rod 234. This requires a large number of component parts and, hence, higher cost. In addition, assembling the door lock is difficult because the actuator 232 and door lock operating unit 230 are separate elements. If the door lock assembly has a self-cancelling mechanism, moreover, the heavy connecting rod 234 will impede the unlocking operation or, because of its inertia, will fall back into its former position once the assembly has been unlocked, thereby inadvertently restoring the locked state. Thus, this arrangement is prone to erroneous operation. These disadvantages constitute a second problem to be solved.

Accordingly, a second object of the invention is to provide a compact door lock assembly that does not employ a connecting rod.

Another example of a conventional door lock assembly of the abovementioned type is disclosed in the specification of Japanese Patent Application Laid-Open No. 59-109678. When this conventional door lock assembly is locked and unlocked automatically, a rotational member formed to include a spirally shape cam groove is rotated by a motor so that a follower engaged with the cam groove is moved from a neutral position of the cam groove to the end thereof to be rocked about a bolt, whereby a lock/unlock member operatively associated with the follower is caused to undergo rocking motion to establish a locked or unlocked state. After the assembly is locked and unlocked, the rotational member is restored to the neutral position by the biasing force of a coil spring. When this conventional door lock assembly is locked and unlocked manually, the lock/unlock member is rocked manually to establish the locked and unlocked state when the rotational member is in the neutral position, namely when the follower is in a position within the cam groove at which it can be rocked to an extent that will enable the assembly to be locked and unlocked.

If the rotational resistance of the rotational member in this conventional door lock assembly increases to such an extent that the rotational member is no longer restored to the neutral position by the biasing force of the coil spring, the follower will no longer be capable of rocking far enough to place the door lock assembly in the locked and unlocked states due to the wall of the cam groove. Consequently, the lock/unlock member will not be capable of being rocked manually to place the door lock assembly in the locked and unlocked states. This is a third problem to be solved by the invention.

Accordingly, a third object of the present invention is to provide a door lock assembly in which the locked and unlocked states can be attained both automatically and manually even if the rotational member is not restored to the neutral position.

SUMMARY OF THE INVENTION

According to the present invention, the first object is attained by providing a door lock assembly comprising a door lock operating unit having a locking arm, and an actuator for driving the locking arm to a locked position and unlocked position, the actuator including an operating lever which rocks together with the locking arm, a neutral position restoration lever which, when in a neutral position, is in a state non-engagable with the operating lever and, when displaced from the neutral position, drives the operating lever to the locked position and unlocked position, an output member which makes contact with an separates from the neutral position restoration lever for driving the neutral position restoration lever to the locked position and unlocked position, and a motor for driving the output member.

Thus, the door lock assembly according to this aspect of the invention comprises the locking arm, the door lock operating unit and the actuator, and the actuator includes the operating lever, the neutral position restoration lever, the output member and the motor. The operating lever is adapted to rock in unison with the locking arm. For example, the operating lever can be connected to the shaft portion of the locking arm to turn the locking arm about the shaft.

The neutral position restoration lever engages the operating lever by being positionally displaced, and thus drives the operating lever to the locked position and unlocked position. The neutral position restoration lever is disposed at the neutral position, in which the lever does not engage the operating lever even when the latter is rocked back and forth. Provided between the neutral position restoration lever and the operating lever is a play interval having a fixed amount of play for allowing displacement from the locked position to the unlocked position and vice versa. For example, the operating lever can be of a bifurcated type having a non-engagement interval corresponding to the aforementioned play interval, and the neutral position restoration lever can be disposed in this non-engagement interval. This non-engagement interval portion can be set on the operating lever side or neutral position restoration lever side.

The output member is adapted to drive the neutral position restoration lever to the locked position and unlocked position. The output member, which need not be maintained in constant engagement with the neutral position restoration lever, drives the restoration lever when in contact therewith. Drive ends when the output member parts from the restoration lever. For example, the output member may comprise a rotational body the peripheral portion of which is provided with an engaging finger projecting substantially at right angles to the direction of rotation.

The motor can be of the conventional type and preferably is reversible.

The operating lever, neutral position restoration lever, output member and motor constituting the actuator can be accommodated in a housing.

The door lock operating unit can be of the conventional type equipped with such elements as an opening lever, release lever, ball and latch. Preferably, the locking arm that actuates the operating unit rocks together with the operating lever.

In operation, the door lock assembly according to this aspect of the invention is locked and unlocked manually or electrically, with the actuator being used in the latter case.

To operate the assembly electrically, a locking switch, by way of example, belonging to the actuator is placed in the ON position, whereupon the motor is driven into operation to move the output member. As a result, the output member shifts the neutral position restoration lever, which is located at the neutral position, to the locked position. The operating lever is turned to the locked position by this displacement of the neutral position restoration lever. When the turning motion of the operating lever ends, the neutral position restoration lever returns to the neutral position, so that the aforementioned play interval allowing displacement to the locked position is formed between the neutral position restoration lever and the operating lever. Owing to the turning motion of the operating lever, the locking arm is rocked in unison with the operating lever, whereby the door lock operating unit is actuated to establish the locked state.

If an unlocking operation is performed with the assembly in the locked state, an unlock switch provided on the actuator is placed in the ON position, in response to which the motor is rotated in the reverse direction. This causes the output member, neutral position restoration lever, operating lever and locking arm to move in directions opposite to those in which they moved in the locking operation, thereby placing the door lock unit in the unlocked state. In this state, the neutral position restoration lever is in the neutral position so that the play interval allowing displacement to the unlocked position is formed. Accordingly, if the locking or unlocking operation is performed manually, in either case the play interval will be present between the operating lever and the neutral position restoration lever, thereby allowing the locking arm to be manipulated manually independently of the actuator.

According to the present invention, the second object is attained by providing a door lock assembly comprising a base, a locking arm freely rockably supported on the base, a door lock operating unit driven by the locking arm, an actuator for driving the locking arm, and a shaft axially supported by the base for rocking together with the locking arm, the actuator being adapted to drive the locking arm via the shaft.

Thus, the door lock assembly according to this aspect of the invention is composed of the shaft, the base, the locking arm, the door lock operating unit and the actuator.

The shaft, which is a characterized feature of the invention, rocks together with the locking arm and is adapted to transmit the output of the actuator. The shaft can be the output shaft of the actuator or the rocker shaft of the locking arm and can directly connect the actuator and the locking arm.

The base supports the locking arm and axially supports the shaft. The base can be constructed as a wall forming a housing that accommodates the assembly.

In this aspect of the invention, the door lock operating unit and the actuator can be the same as those used in the prior art.

In operation, the door lock assembly according to this aspect of the invention is locked and unlocked electrically through use of the actuator by placing the actuator switch in the ON position. In response, the output of the actuator acts directly upon the shaft of the locking arm so that the latter is rockingly driven together with the shaft. The door lock operating unit is actuated by drive of the locking arm, thereby placing the door lock assembly in the locked or unlocked state.

According to the present invention, the third object is attained by providing a door lock assembly in which the actuator comprises drive means, output means operatively associated with the drive means and having a projection, and an operating lever which comes into butting contact with the projection for operating a locking arm in operative association with the output means, the actuator being adapted to operate the locking arm automatically.

When the locking arm is rocked manually to perform a locking and unlocking operation in a case where the output means will not return to a neutral position due to resistance after the door lock operating unit has effected a locking and unlocking operation automatically by virtue of the drive means, the operating lever comes into contact with the projection on the output means to rotate the output means against the aforementioned resistance. As a result, the locking arm is capable of being rocked to lock and unlock the door.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIGS. 1 through 8 are views relating to an embodiment of door lock assembly according to the present invention, in which:

FIG. 1 is a perspective view showing the overall door lock assembly;

FIG. 2 is an exploded perspective view showing the principal portions of the door lock assembly;

FIG. 3 is an external view of an actuator included in the door lock assembly;

FIG. 4 is a plan view showing the internal mechanism of the door lock assembly;

FIG. 5 is a sectional view taken along line V—V of FIG. 4;

FIG. 6 is a plan view illustrating the construction of a door lock operating unit included in the door lock assembly;

FIG. 7 is a view showing the operation of the door lock assembly when shifted from an unlocked to a locked state; and FIG. 8 is a view showing the operation of the door lock assembly when shifted from a locked to an unlocked state;

DESCRIPTION OF THE PREFERRED EMBODIMENT

A specific embodiment of a door lock assembly according to the present invention will now be described with reference to FIGS. 1 through 8.

Figure 1:
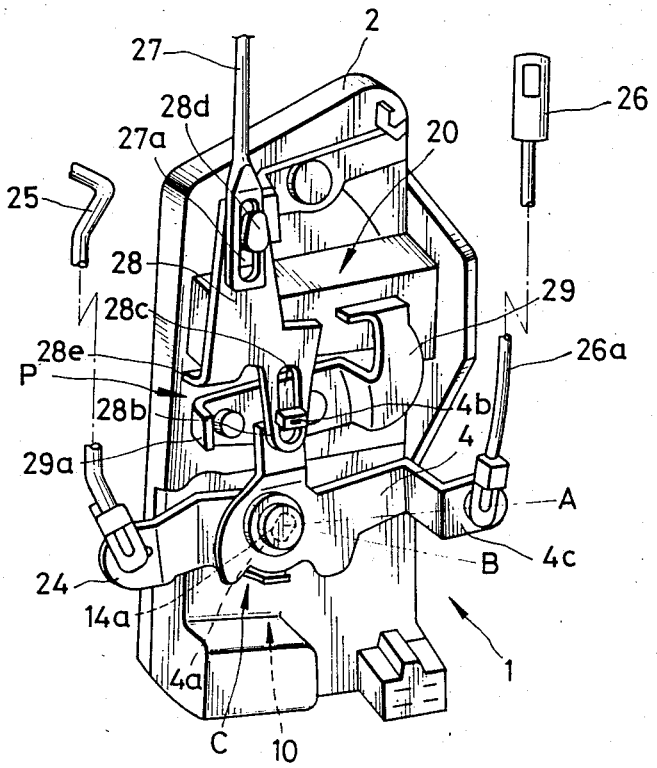
Figure 3:
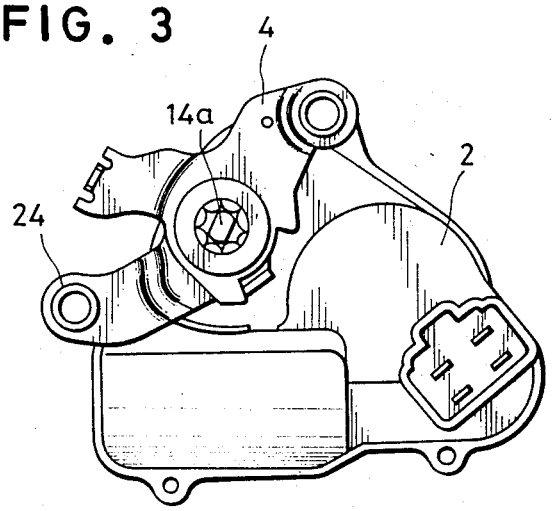
Figure 2:
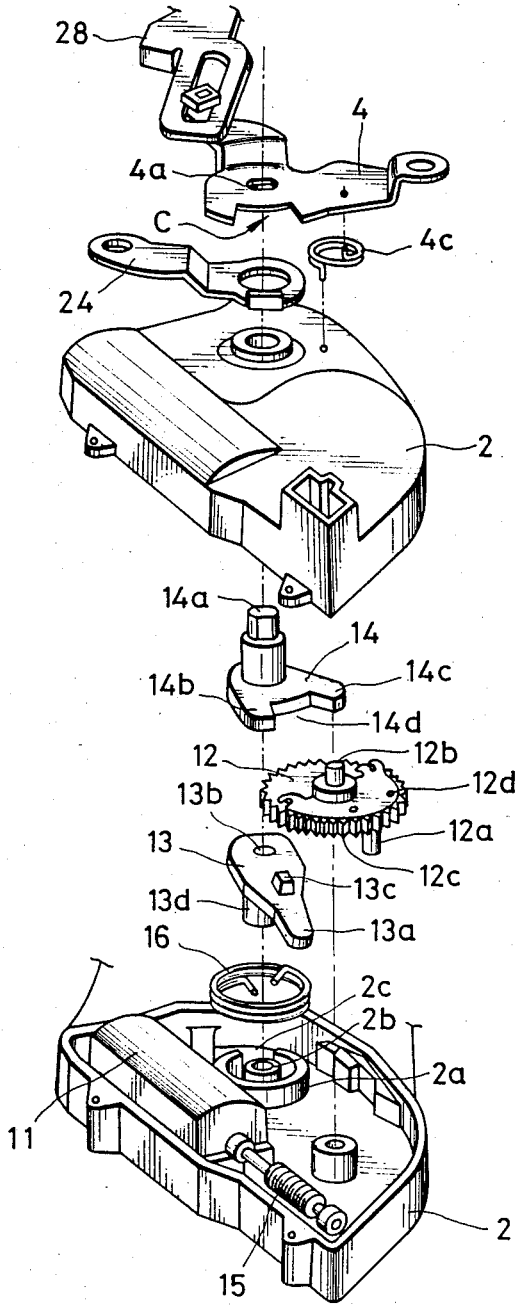
Figure 4:
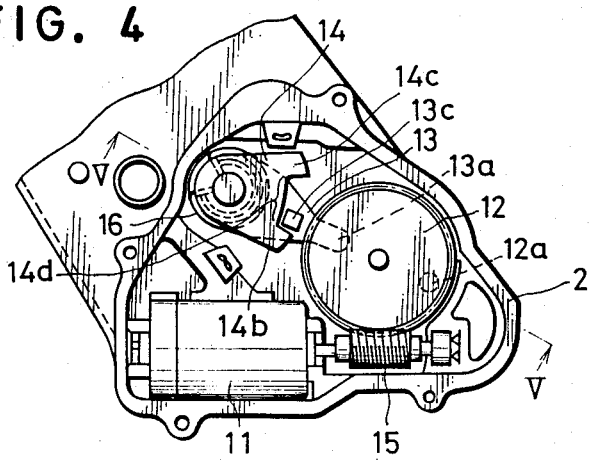
Figure 5:
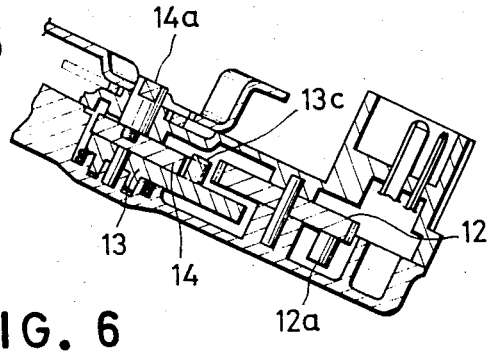

As shown in the overall view of FIG. 1, a door lock assembly 1 embodying the invention includes an actuator 10 and a door lock operating unit 20. The actuator 10 is accommodated in a housing 2 and has an output shaft **14*a* projecting from the housing 2. The output shaft 14*a* is connected to a locking arm 4 by being fitted into an oval rocker shaft hole 4*a* thereof. The locking arm 4 has an end 4*b* freely rockably engaged with an oblong hole 28*c* formed in one end 28*b* of an opening lever 28. The locking arm 4 has another end 4*c* connected via a rod 26*a* to a locking button 26 for performing a locking and unlocking operation in response to manual manipulation. The opening lever 28 has another end 28*d* connected to an inside handle (not shown) and an outside handle (not shown) via a rod 27 freely rockably engaged with the opening lever 28 at an oblong hole 27*a*. The opening lever 28 is formed to include a bent portion 28*e* bent at substantially 90° toward the housing 2. A release lever 29 is disposed in intersecting relation with respect to the opening lever 28 and has an end formed to include a bent portion 29*a* bent away from the housing 2 at substantially 90°. A connection point P at which a connection is mechanically made is constructed by the bent part 29*a* and the bent portion 28*e* of opening lever 28. When the opening lever 28 is operated to bring the bent portion 28*e* and bent portion 29*a* into contact at point P, this state is representative of the unlocked position (i.e. when the locking arm 4 is in the position indicated by A in FIG. 1). When the locking arm 4 is rocked to the position indicated by B in FIG. 1 to establish a disconnected state in which the bent portion 28*e* and bent portion 29*a* are not in contact, this state is representative of the locked position. The release lever 19 is pivotally secured in coaxial relation with a pawl (described below) within the housing 2. The locking arm 4 is provided with a key operation lever 24 freely rotatably supported in the rocking shafthole 4*a* for rocking together with the locking arm 4 via an engaging mechanism C. The key operation lever 24 is connected with a key cylinder by means of a rod 25. The locking arm 4 is tied to the housing 2 via a reversing spring 4*c* (shown in FIG. 2**) and is capable of being held in the unlocked position A or unlocked position B by the spring.

As shown in FIGS. 2 through 5, the actuator 10 comprises a motor 11, an output member 12, a neutral position restoration lever 13 and an operating lever 14.

A motor 11 is rotatable forwardly and reversely and has a rotary shaft to which a worm 15 is secured.

The output member 12 is a worm wheel rotatably supported by a shaft **12*b* and having an outer circumferential portion 12*c* meshing with the worm 15 of motor 11. The peripheral portion of output member 12 is formed to include an engaging finger projecting downwardly at substantially right angles with respect to the direction of rotation. The output member 12*a* is provided with a movable contact 12*d* connected to a fixed contact (not shown) provided on the housing side. These two contacts are rendered conductive when a lock switch or unlock switch (not shown) is turned on, as a result of which the motor 11 is driven into rotation to rotate the engaging finger 12*a* through one revolution from the neutral position. When the finger 12***a* returns to the neutral position upon making this full revolution, a changeover is made to the opposite side, namely the locked side or unlocked side, and the motor stops.

The neutral position restoration lever 13 has a rotational shaft portion 13*d* the distal end of which is fitted between a circular outer protuberance 2*a* and a circular inner protuberance 2*b* formed on the housing 2. The outer protuberance 2*a* is formed to include a cut-out 2*c* over an angle of about 90°, and the rotational shaft portion 13*d* is formed to include a cut-out (not shown) corresponding to the cut-out 2*c*. A spring 16 is fitted on the outer periphery of the outer protuberance 2*a*. One end of the spring 16 is bent inwardly and anchored in an end portion of the cut-out 2*c* in outer protuberance 2*a*, and the other end of the spring is bent inwardly and anchored in an end portion of the cut-out in rotational shaft portion 13*d*. The neutral position restoration lever 13 is biased by the spring 16 so as to return the predetermined neutral position. The neutral position restoration lever 13 also has an arm portion 13*a*. As the output member 12 turns, the engaging finger 12*a* thereof comes into contact with and separates from the arm portion 13*a*, so that the neutral position restoration lever 13 is turned back and forth about a rotational shaft hole 13*b* in the neutral position restoration lever 13. The latter is also formed to include a projection 13*c* projecting upward at substantially right angles with respect to the direction of rotation.

The operating lever 14 has the aforementioned output shaft 14*a* supported by the housing 2 with one end thereof being inserted into the rotational shaft hole 13*b* of neutral position restoration lever 13. The other end of the output shaft 14*a* , which constitutes the output shaft of the actuator 10, projects from the housing 2 and is fixedly secured in the oval rocker shaft hole 4*a* formed in the locking arm 4. The operating arm 14 also has engagement portions 14*b*, 14*c* between which is formed a non-engagement interval 14*d* corresponding to the operating angle portion of the locking arm 4. The projection 13*c* of neutral position restoration lever 13 is disposed in the non-engagement interval 14*d*.

Figure 6:
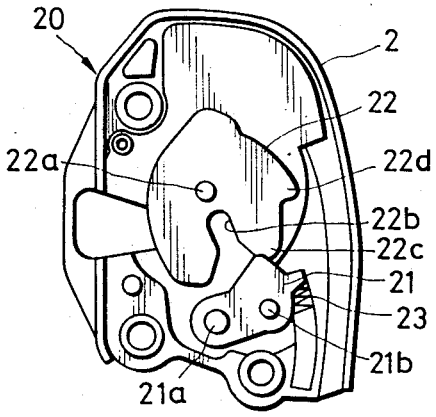

As shown in FIG. 6, the door lock operating unit 20 includes a pawl 21, a latch 22 and a spring 23, all of which are accommodated in the housing 2. The pawl 21 is mounted so as to be freely rotatable back and forth about its shaft 21*a* in coaxial relation with respect to the release lever 29. The release lever 29 and pawl 21 are connected via a pin so as to be operatively associated with each other. The arrangement is such that the pawl 21 is taken out of engagement with the latch 22 against the biasing force of the spring 23 by rocking motion of the release lever 29. The latch 22 is supported so as to be freely rotatable back and forth about a shaft 22*a* and is formed to include a groove 22*b* for engaging a striker (not shown), a full-latch tooth 22*c* for engaging the pawl 21, and a half-latch tooth 22*d* for engaging the pawl 21.

The operation of the door lock assembly according to this embodiment of the invention will now be described.

In FIG. 1, the door lock assembly is shown to be in the unlocked state. When the opening lever 28 is pushed downwardly under these conditions, the bent portion 28 of the opening lever 28 contacts the release lever 29 at the connection point P, so that the release lever 29 is turned about the shaft 21*a*. As a result, the pawl 21 turns and is taken out of engagement with the latch 22. This represents the door opening state.

Figure 7:
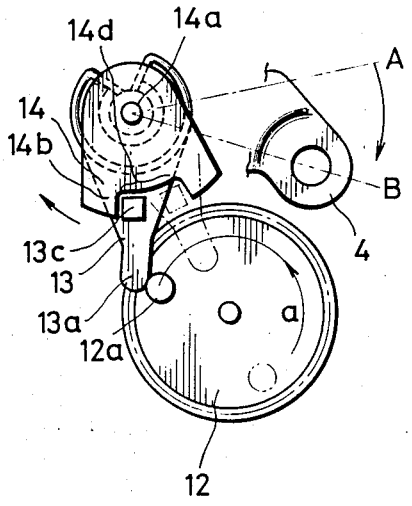

FIG. 7 illustrates the actuator 10 in a case where the door lock assembly described above is shifted from the unlocked state to the locked state. When the locking switch (not shown) of the actuator 10 is placed in the ON position, the motor (not shown) is driven into operation to turn the output member 12 via the worm 15. The output member 12 makes one full revolution in the direction of the arrow a, starting from the neutral position. With the rotation of the output member 12 that occurs at this time, the engaging finger 12*a* strikes the side portion of the arm 13*a*, so that the neutral position restoration lever 13 is turned from the neutral position (indicated by the phantom line) to the locked position (indicated by the solid line). Owing to this turning motion of the neutral position restoration lever 13, the projection 13*c* thereof engages the engaging portion 14*b* of operating lever 14, whereby the operating lever 14 is turned to the locked position about the output shaft 14*a*. The turning of the operating lever 14 is accompanied by the rocking of the locking arm 4 from an unlocked position A to a locked position B about a connection hole (not shown), whereby the door lock operating unit (not shown) is actuated to establish the locked state.

As the output member 12 turns further and causes the engaging finger 12*a* to part from the arm 13*a*, the neutral position restoration lever 13 is returned to the neutral position by the spring (not shown), so that the projection 13*c* is situated at the side of the engagement portion 14*c* on the opposite side. In this state, play is allowed in the non-engagement interval 14*d* between the projection 13*c* and the engagement portion 14*b* of operating lever 14. Accordingly, if the locking button 25 is operated manually to rock the locking arm 4 and establish the unlocked state, the neutral position restoration lever 13 offers no resistance even though the operating lever 14 rocks together with the locking arm 4.

Figure 8:
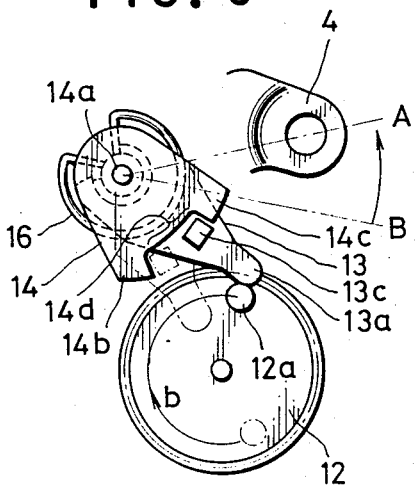

When the unlocking switch (not shown) of the actuator is placed in the ON position in a state where the assembly is locked, as shown in FIG. 8, the motor (not shown) rotates in the reverse direction and, hence, so does the output member 12 (the direction of rotation thereof is indicated by the arrow b in FIG. 8). Owing to this rotation of the output member 12, the neutral position restoration lever 13 and operating lever 14 operate in directions opposite to those which prevailed at the time of the locking operation, so that the door lock operating unit 20 is actuated to establish the unlocked state. Even in the unlocked state the play interval is formed by the non-engagement interval 14*d* between the projection 13*c* of neutral position restoration lever 13 and the engagement portion 14*b* of operating lever 14.

Thus, in the door lock assembly of the present embodiment as described above, the non-engagement interval is provided between the neutral position restoration lever 13 and the output lever 14, and the neutral position restoration lever 13 is restored to the neutral position by the output member 12 and spring 16. This makes it possible to perform the manual locking and unlocking operations smoothly with a small operating force. Since the invention makes it possible to reduce the size of the actuator 10, the latter can be integrated with the door lock operating unit 20 and accommodated therewith inside the housing 2. This enables a compact door lock assembly to be obtained. Furthermore, since there is almost no load upon the motor when the door lock assembly is operated manually, the motor can be made small in size.

Figure 9:
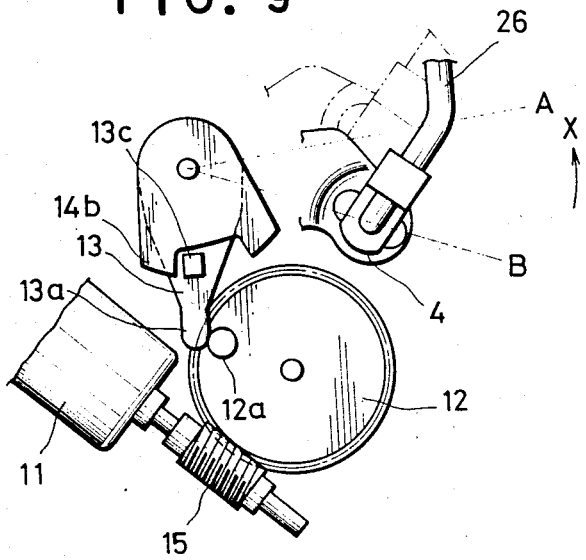
FIG. 9 is a view showing an example of application of the invention.

An example of a door lock assembly applying the present invention will now be described in which there is provided a controller for fixing the actuator against movement in a state where the door lock assembly of the foregoing embodiment is locked and cannot be unlocked manually. As shown in FIG. 9, the controller effects control so as to halt motion when the locking switch (not shown) is placed in the ON position to bring the finger 12*a* of output member 12 into engagement with the arm 13*a* and rotate the output member to the locked position. In this state the locking lever 4 is in the locked position D. However, the arm 13*a* of neutral position restoration lever 13 is in engagement with the finger 12*a* and cannot return to the neutral position. Further, movement of the output member 12 is completely prevented by the action of the worm. In addition, since the projection 13*c* of neutral position restoration lever 13 and the engagement portion 14*b* of output lever 14 are engaging each other, the output lever 14 cannot be moved to the unlocked position. Therefore, since the locking arm 4 cannot be rocked from the locked position F to the unlocked position E, the unlocking operation cannot be performed manually via the rod 26*a*. This means that improper means such as a wire or the like cannot be used to unlock the door by operating such elements as the locking arm 4. This is effective in preventing theft. It is possible to readily control this state electrically to realize a theft prevention system. Accordingly, such theft prevention can be readily achieved without increasing the number of component parts.

Thus, in accordance with this aspect of the door lock assembly of the present invention, the actuator comprises a door lock operating unit having a locking arm, and an actuator for driving the locking arm to a locked position and unlocked position, the actuator including an operating lever which rocks together with the locking arm, a neutral position restoration lever which, when in a neutral position, is in a state non-engagable with the operating lever and, when displaced from the neutral position, drives the operating lever to the locked position and unlocked position, an output member which makes contact with an separates from the neutral position restoration lever for driving the neutral position restoration lever to the locked position and unlocked position, and a motor for driving the output member. Accordingly, the locking and unlocking operations can be performed smoothly and with a small force even when the assembly is operated manually by the locking button or a key. In addition, the door lock assembly is compact and simple in structure.

Another embodiment of a door lock assembly according to the invention will now be described.

Figure 10:
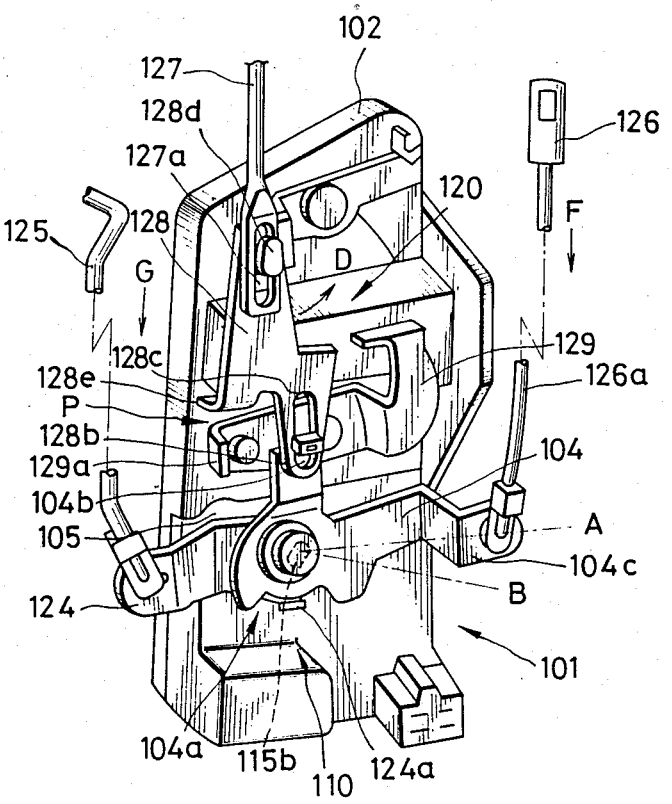
FIG. 10 is a perspective view illustrating another embodiment of an door lock assembly according to the invention.

This embodiment of the door lock assembly, designated at numeral 101 in FIG. 10, includes an actuator 101 and a door lock operating unit 120. The actuator 101 is accommodated in a housing 102. The door lock operating unit 120 is operated to actuate a well-known door lock actuating unit (not shown) accommodated in the housing 102, whereby the door (not shown) is locked and unlocked.

Figure 11:
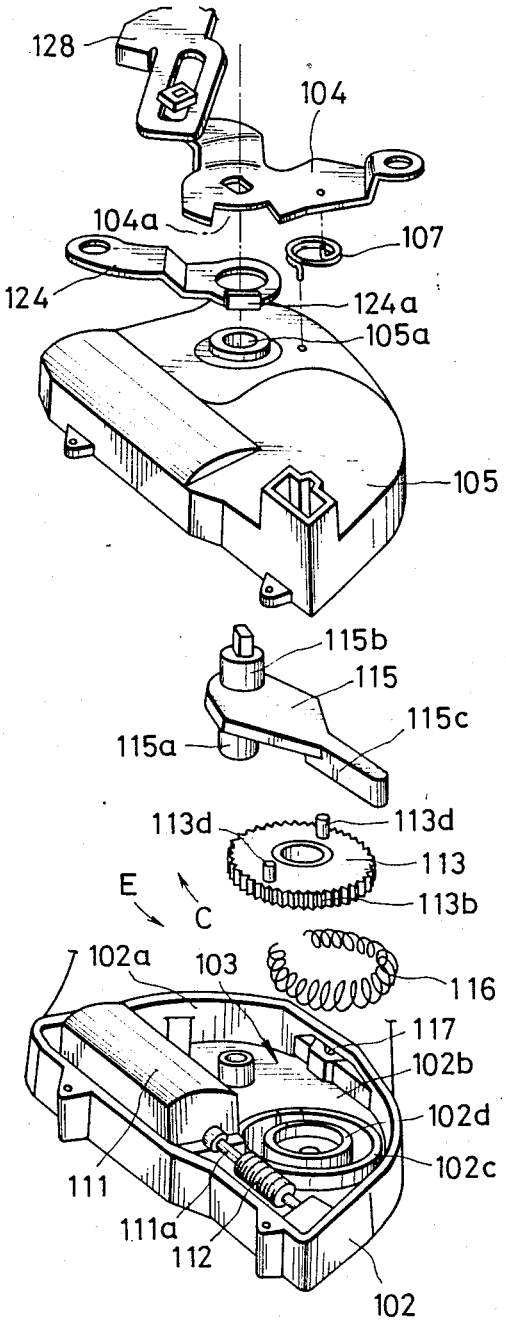
FIG. 11 is an exploded perspective view of an actuator included in the door lock assembly of FIG. 10.
Figure 12:
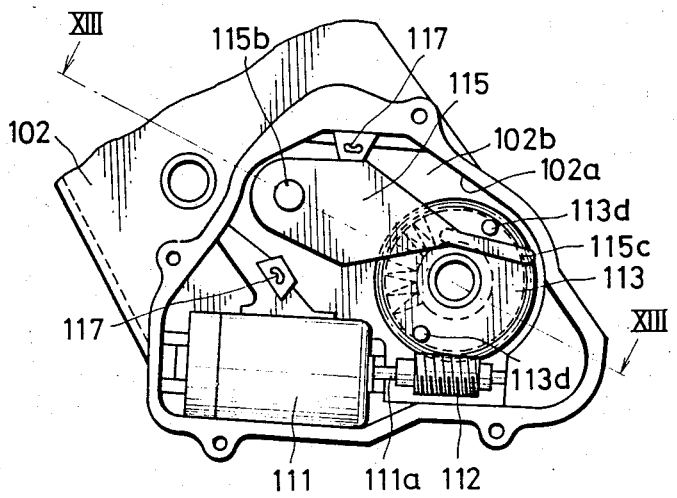
FIG. 12 is a view showing the actuator of FIG. 11 in the assembled state.
Figure 13:
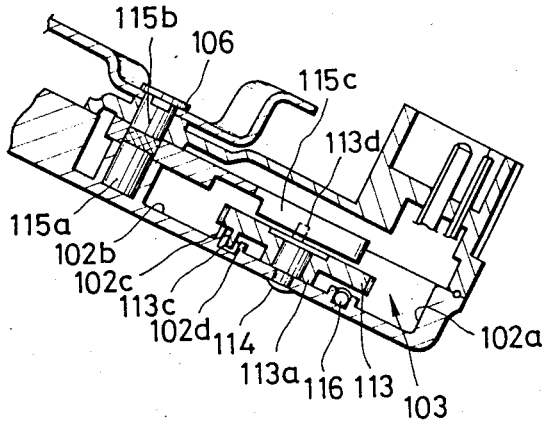
FIG. 13 is a sectional view taken along line XIII—XIII of FIG. 12.
Figure 15:
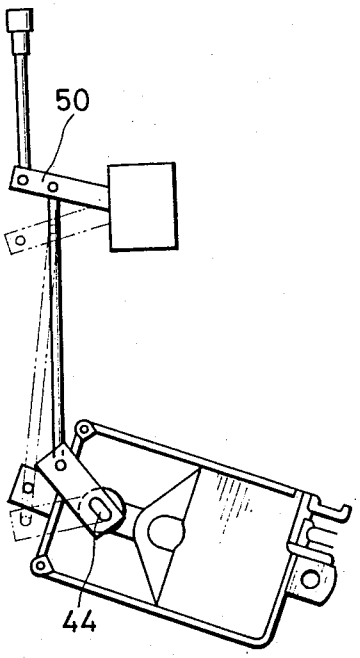
FIG. 15 PRIOR ART
FIGS. 14 through 17 are views illustrating door lock assemblies according to the prior art.
Figure 14:
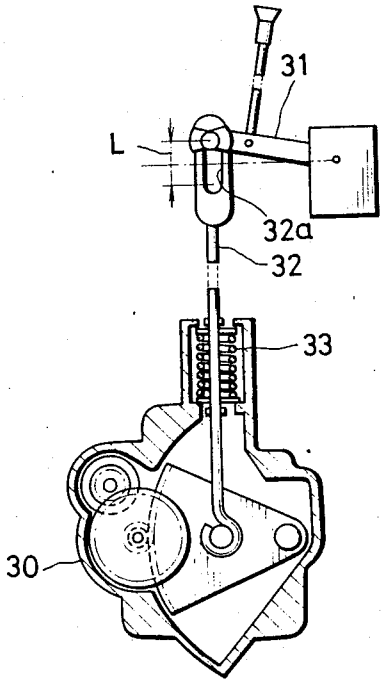
FIG. 14 PRIOR ART
Figure 17:
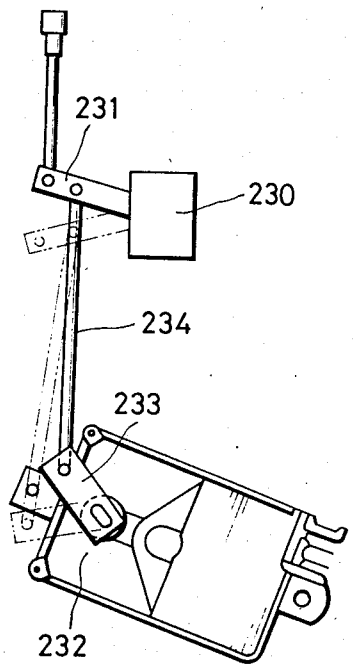
FIG. 17 PRIOR ART
Figure 16:
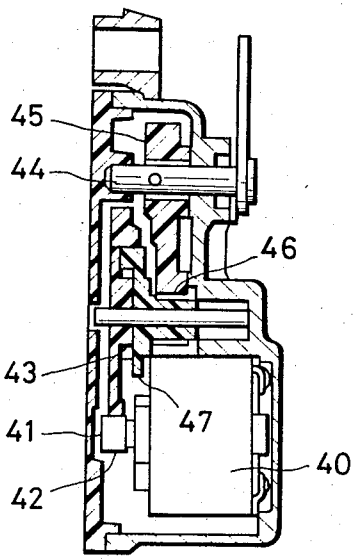
FIG. 16 PRIOR ART

The actuator 110 will now be described with reference to FIGS. 11 through 13.

The actuator 110 is received in a space 103 formed in the housing 102 by an inner wall 102*a* and bottom wall 102*b*. Secured in the space 103 is a reversible motor 111 having a rotary shaft 111*a* to which a worm gear 112 is secured so as to be capable of rotating together with the shaft. Formed on the bottom wall 102*b* in space 103 is an outer protuberance 102*c* and an inner protuberance 102*d* situated inside the outer protuberance 102*c*. Rotatably supported on the outer protuberance 102*c* and inner protuberance 102*d* by a pin 114 is a rotational body 113 retained in the inner protuberance 102*d* by a flange 113*a*. Formed on the outer circumferential portion of the rotational body 113 are teeth 113*b* having a lead angle.

The rotational body 13 constitutes a worm wheel and is in mesh with the worm gear 112. The lead angle of the worm gear 112 is set to be larger than the frictional angle between the worm gear 112 and the rotational body 113. (By way of example, if the worm gear 112 and rotational body 113 are made of cast iron, the coefficient of friction would be $\mu=0.1-0.15$. Therefore, from $\mu=\tan\Lambda$, the frictional angle would be $\Lambda=6.34°-9.48°$. Accordingly, the lead angle would be set to no less than 9.48°.) The worm gear 112 can be rotated from the rotational body 113. Disposed between the outer protuberance 102*c* and inner protuberance 102*d* is a spring 116 having its one end secured to the housing 102 and its other end tied to a projection 113*c* provided on the bottom surface of the rotational body 113. The rotational body 113 is constantly biased by the spring so as to be restored to a predetermined position. Fingers 113*d* are provided on the top surface of the rotational body 113.

An operating lever 115 is integrally formed to include a boss 115*a* projecting toward the bottom wall 102*b* and is supported by the boss 115*a* so as to be rotatable back and forth on the bottom wall 102*b* of space 103. The operating lever 115 is integrally formed to include a shaft 115*b* on the side opposite the boss 115*a* and coaxial therewith. The operating lever is further formed to include an arm 115*c* capable of bring brought into engagement with the fingers 113*d* on the rotational body 113. A stopper 117 is provided on the inner wall 102*a* of space 103 for limiting the range of rotation of operating lever 115. The actuator 110 having the above-described construction is covered by a base portion 105. The shaft 115*b* serves as the output shaft of the actuator 110 and projects to the exterior through an insertion hole 105*a* provided in the base portion 105.

The door lock operating unit will now be described.

As shown in FIG. 10, a locking arm 104 is fixedly caulked on the shaft 115*b* and is supported so as to be co-rotatable with the operating lever 115. One end 128*b* of an opening lever 128 is freely rockably retained on one end 104*b* of the locking arm 104 via an oblong hole 128. Connected to the other end 104*c* of the locking arm 104 via a rod 126*a* is a locking button 126 for locking and unlocking the door by means of a manual operation. The opening lever 128 has another end 128*d* freely rockably engaged with an oblong hole 127*a* formed in a rod 127 and connected to an inside handle (not shown) and an outside handle (not shown) via the rod 127. Also arranged in the housing 102 is a release lever 129 pivotally supported in coaxial relation with a pawl (not shown) in the well-known actuating unit. The release lever 129, which is for actuating the pawl to lock and unlock the door, is freely rockable arranged in intersecting relation with respect to the opening lever 128. The opening lever 128 is formed to include a butting contact portion 128*e* bent at substantially right angles toward the base portion 103. The release lever 129 is formed to include a butting contact portion 129*a* bent at substantially right angles away from the base portion 103. The butting contact portion 128*e* of opening lever 128 and the butting contact portion 129*a* of release lever 129 come into butting contact with each other at a connection point P and are capable of being mechanically connected at this point. Pivotally supported on the shaft 115*b* is a key operating lever 124. A cut-out 104*a* formed in the locking arm 104 and an engagement portion 124*a* formed on the key operating lever 124 mate with each other. Thus, the locking lever 104 is operated by operating the key operating lever 124. The key operating lever 124 is connected to a key cylinder (not shown) via a rod 125. The locking arm 104 is held on the base portion 105 by a spring (FIG. 11) and is thus capable of being held in an unlocked position A and a locked position B for placing the door in the unlocked and locked states.

The operation of this embodiment will now be described with reference to FIGS. 10 through 13.

FIG. 10 shows the door lock assembly 101 in a state capable of locking a vehicle door. By operating the outside handle or inside handle, the rod 127 is pushed to bring the butting contact portion 128*e* of opening lever 128 and the butting contact portion 129*a* of release lever 129 into contact at the connection point P, whereby the release lever 129 is turned to take the pawl of the door lock actuating unit out of engagement with the latch, as a result of which the door is placed in the unlocked state. If the motor 111 is operated to turn the rotary shaft 111*a* starting from the state shown in FIG. 10, then the rotational body 113 is rotated in the direction C in FIG. 11 due to the meshing engagement between the worm gear 112 and the rotational body 113. Owing to this rotation of the rotational body 113, the finger 113*d* on the body 113 comes into butting contact with the arm 115*c* of operating lever 115, so that the latter is turned about the shaft 115*b* from the neutral position to until the stopper 117 is contacted. The excitation time of the motor 111 is controlled. The operating lever 115 is turned for a period of time necessary for it to contact the stopper 117, after which the rotation is stopped. Since the setting is such that the lead angle of the worm 112 will be larger than the frictional angle between the worm 112 and rotational body 113, at this time the rotational body 113 is rotated in the direction E in FIG. 11 by the biasing force of the spring 116 and is thus returned to the neutral position. Owing to the turning motion of the operating lever 115, the locking arm 104, which is supported on the shaft 115*b* of the operating lever 115 so as to be capable of freely co-rotating therewith, is turned from the unlocked position A to the locked position B. As a result, the opening lever 128 is rocked in the direction D in FIG. 10, so that the butting contact portion 128*e* moves from the connection point P. In consequence, the butting contact portion 128*e* of opening lever 128 and the butting contact portion 129*a* of release lever 129 break contact. Therefore, the door assumes the locked state without turning of the release lever 129, even if the inside handle and outside handle are operated. By rotating the motor 111 from this state in a direction opposite to that above, the door can be unlocked.

The door can be unlocked and locked by a manual operation as well. If the user presses the locking button 126 by hand in the direction F shown in FIG. 10 starting from the unlocked state of FIG. 10, the locking arm 104 will turn from the unlocked position A to the locked position B together with the operating lever 115. At this time the rotational body 113 will have been restored to the neutral position, so that the finger 113*d* on the rotational body 113 will be outside the turning range of the operating lever 115. Thus, turning of the operating lever 115 is unimpeded. As a result, since the opening lever 128 is rocked in the direction D in FIG. 10, the door is locked just as when the motor 111 was rotated. At this time the operating lever 115 turns in unison with the locking arm 104.

If the user rotates the key cylinder manually by a key starting from the unlocked state of FIG. 10, the rod 125 is pushed in the direction G shown in FIG. 10, thereby rotating the key operating lever 124 to bring the engagement portion 124*a* of key operating lever 124 and the side wall of the cut-out 104*a* of locking arm 104 into contact. This causes the locking arm 104 to turn from the unlocked position A to the locked position B. As a result, the opening lever 128 is rocked in the direction D in FIG. 10, so that the door is locked just as when the motor 111 was rotated. At this time, the operating lever 124 turns in unison with the locking arm 104, as set forth above. If the rod 125 operated by the locking button 126 and the rotation of the key cylinder is pulled starting from the aforementioned locked state, the locking arm 104 is turned from the locked position B to the unlocked position A, so that the door is unlocked.

Note that when the door is unlocked and locked manually, the motor 111 is not driven, so that the rotational body 113 is in the neutral position at all times.

If locking arm 104 is turned manually to lock and unlock the door in a case where the rotational body 113 does not return to the neutral position because of damage to the spring 116, frictional resistance caused by aging, etc. when the door is unlocked and locked by driving the motor, the arm 115*c* of operating lever 115 and the finger 113*d* on rotational body 113 come into contact since the length of the operating lever 104 from its rotational center to the action point at which it contacts the finger 113*d* on the rotational body 113 is great. This causes the rotational body 113 to turn at the same time as the locking arm 104. Accordingly, even if the rotational body 113 is not restored to the neutral position, the locking arm 104 is rotated to enable the door to be unlocked and locked.

By forming the stopper 117 from a resilient body, the stopper will absorb the energy produced when the operating lever 115 strikes it, and the operating lever 115 is be restored to the neutral position by the reaction force of the stopper 117. Thus, even if the rotational body 113 is not restored to the neutral position, the finger 113*d* on the rotational body 113 will not interfere with the turning motion of the operating lever 115. Thus, the door will be capable of being locked and unlocked. By adopting the abovedescribed arrangement, the spring 116 can be imparted with a biasing force sufficient for turning the rotational body 113 smoothly.

In order to attain the third object of the invention in a prior art arrangement, it may be contemplated to enlarge the cam groove and widen the cam groove so that the lock/unlock member will be capable of rocking at the locked and unlocked positions of the cam groove, or to incline the cam face of the cam groove in such a manner that the rotational member will rotate. However, with these technical expedients, the rotational member is increased in size and the door lock assembly is made too large to mount on the door. In accordance with the door lock assembly of the invention, however, the actuator places the door in the unlocked state and locked state by a combination of the drive means, output means operatively associated with the drive means and having a projection, and an operating lever which comes into butting contact with the projection for operating a locking arm in operative association with the output means. Therefore, the door lock assembly can be made compact and force can be transmitted from the output means to the operating lever and from the operating lever to the output means regardless of the position of the output means. As a result, the door can be manually locked and unlocked in all cases.

As many apparently widely different embodiments of the present invention can be made without departing from the spirit and scope thereof, it is to be understood that the invention is not limited to the specific embodiments thereof except as defined in the appended claims.

What is claimed is:

1. A door lock assembly comprising:
a door lock operating unit having a locking arm, and
an actuator for driving said locking arm to a locked position and an unlocked position, said actuator including:
an operating lever which rocks together with said locking arm;
a neutral position restoration lever which, when in a neutral position, is in a state non-engagable with said operating lever and, when displaced from the neutral position, drives said operating lever to the locked position and unlocked position;
an output member which makes contact with and separates from said neutral position restoration lever for driving said neutral position restoration lever to the locked position and unlocked position; and
a motor for driving said output member.

2. The door lock assembly according to claim 1, wherein said output member comprises a rotational body having an engaging projection on a peripheral portion thereof.

3. A door lock assembly comprising:
a base;
a locking arm freely rockably supported on said base;
a door lock operating unit driven by said locking arm;
an actuator for driving said locking arm; and
a shaft axially supported by said base for rocking together with said locking arm, said actuator being adapted to drive said locking arm via said shaft.

4. The door lock assembly according to claim 3, wherein said base comprises a wall forming a housing, said actuator is accommodated within said housing, and said shaft projects into said housing through said wall.

5. A door lock assembly according to claim 1, further comprising a base portion carrying said door lock operating unit, and a housing internally accommodating said actuator, said base portion being integrally molded from a synthetic resin and said housing being sealingly secured to said base portion.

6. A door lock assembly according to claim 5, wherein said output member is a worm wheel, and the assembly includes a worm fixed on said motor in rotatable engagement with said worm wheel and driven by external force from said motor, and said worm wheel includes a projection being brought into contact with said operating lever during operation of said motor, the projection being spaced from said operating lever at times when said operating lever is in either the locked or unlocked position.

7. A door lock assembly according to claim 5, wherein said door lock operating unit includes a key operating lever rotatably supported on said housing in cooperation with said locking arm, said locking arm and said key operating lever having axially aligned rotational axes.

8. A door lock assembly according to claim 5, further comprising a pair of stoppers for limiting the range of rotation of said operating lever, each said stopper being secured internally of said housing.

9. A door lock assembly comprising:
a door lock operating unit having a locking arm, and
an actuator for driving said locking arm to a locked position and an unlocked position, said actuator including:
an operating lever which rocks together with said locking arm,
an output member movable from an original position for making contact with and separating from said operating lever for driving said operating lever to the locked position and unlocked position,
a motor for driving said output member, and
a neutral position restoration member for restoring the output member to the original position after movement of said operating lever either to the locked or unlocked position.

10. A door lock assembly according to claim 9, wherein said output member is a worm wheel, and the assembly includes a worm fixed on said motor in rotatable engagement with said worm wheel and driven by external force from said motor, and said worm wheel includes a projection being brought into contact with said operating lever during operation of the motor the projection being spaced from said operating lever at times when said operating lever is in either the locked or unlocked position.

11. A door lock assembly according to claim 9, further comprising a base portion carrying said door lock operating unit, and a housing internally accommodating said actuator, said base portion being integrally molded from a synthetic resin and said housing being sealingly secured to said base portion.

12. A door lock assembly according to claim 11, wherein a door lock mechanism associated with said door lock operating unit is located on said base portion in parallel with said actuator.

13. A door lock assembly according to claim 11, wherein said door lock operating unit includes a key operating lever rotatably supported on said housing in cooperation with said locking arm, said locking arm and said key operating lever having axially aligned rotational axes.

14. A door lock assembly according to claim 11, further comprising a pair of stoppers for limiting the range of rotation of said operating lever, each said stopper being secured internally of said housing.

* * * * *